US005647240A

United States Patent [19]

Jacobson

[11] Patent Number: 5,647,240

[45] Date of Patent: Jul. 15, 1997

[54] PITCH TOOL HOLDER

[75] Inventor: John D. Jacobson, Southington, Conn.

[73] Assignee: Newcomb Spring Corporation, Southington, Conn.

[21] Appl. No.: 508,830

[22] Filed: Jul. 28, 1995

[51] Int. Cl.[6] ..... B21F 3/02; B21D 37/04

[52] U.S. Cl. ..... 72/135; 72/481.6

[58] Field of Search ..... 72/133, 135, 138, 72/143, 481.1, 481.6, 481.7, 481.4, 482.2; 407/91, 94, 107, 108, 109; 269/91, 97; 279/110

[56] References Cited

U.S. PATENT DOCUMENTS 4,444,036 4/1984 Shibata et al. ..... 72/138

4,991,277 2/1991 Itaya ..... 72/138

5,092,572 3/1992 Litwak et al. ..... 269/97

*Primary Examiner*—Lowell A. Larson

*Assistant Examiner*—Rodney Butter

*Attorney, Agent, or Firm*—Chilton, Alix & Van Kirk

[57] ABSTRACT

A spring coiling machine wherein the pitch tool holder has two active plates which act as a clamp on the stem of the pitch tool. Preferably, the clamping plates are carried on a support based plate or the like, which is moveable linearly in a direction parallel to the pitch stem axis.

10 Claims, 4 Drawing Sheets

PITCH TOOL HOLDER

BACKGROUND OF THE INVENTION

The present invention relates to machines for manufacturing coiled springs, and in particular, to the tool for establishing the spacing between adjacent coils.

The automatic fabrication of springs from a roll of wire, has been practiced for many years, as evidenced by U.S. Pat. No. 2,119,002 issued May 31, 1938 for "Spring Coiling Machine". Some of the basic operating techniques are also disclosed, for example, in U.S. Pat. No. 5,131,251 issued Jul. 21, 1992 for "Chuck Set Up For Spring Coiling Machine", and U.S. Pat. No. 5,201,208 issued Apr. 13, 1993 for "Coiling Point Holder For Spring Coiling Machine", the disclosures of which are hereby incorporated by reference.

FIGS. 1 and 2 illustrate some of such known techniques. The spring coiling machine 10 may be any of numerous makes and models which are employed for manufacturing coil springs in an automatic, highly efficient process. For ease of consistent reference to directionality, FIGS. 1 and 2 include the orthogonal axes indicated with the positive and mutually perpendicular X, Y and Z axes.

The spring coiling machine 10 employs a multiplicity of gears, linkages, levers, cams and power supplies, all of which are operatively integrated for the purposes of feeding, bending, and cutting a wire W at a coiling station 20. Most of these mechanisms are situated behind the front panel 30. The wire W is plastically deformed at the coiling station into a coil spring S having desired characteristics such as diameter, length and pitch which may vary for a given coil. The coil spring S is then severed from the supply wire. The manufacturing sequence is continuously replicated so that multiple coil springs are produced without any interruption in a highly efficient manufacturing process.

The coiling station 20 operates on the workpiece in the form of a continuous wire to produce the coil spring S. The supply of wire W is displaced by feed rolls 24 through a wire guide 26 and a block wire guide 28. The wire is continuously displaced generally parallel to the front face of panel 30 of the machine until it reaches the arbor 32. The front panel 30 of the machine extends outwardly from the plane of FIG. 2 toward the operator. The arbor 32 and the block wire guide 28 are mounted to a tool holder or chuck 40 which is mounted through the front panel 30 and clamped into position. A coiling point 34 contacts the wire as it emerges from between the arbor 32 and the block guide 28 and deformably forces the wire into a generally helical shape. A pitch tool 36 is conventionally wedged at an angle to the wire thereby establishing the pitch of a plurality of successive loops or turns in the coil. When the spring reaches the desired number of turns, a cutting tool 50, for example in the form of a tension assembly having a projecting cutting blade 52, is actuated. The blade 52 is pivotally displaced from the upper left in the direction indicated as a counterclockwise arrow in FIG. 1, to sever the feed wire against the arbor 32 and thereby complete the fabrication of the coil spring S.

In conventional spring coiling machines, it is common to have a plurality of wire rolls 54, 54', 54" each having a wire with a different diameter, shape and/or composition so that for a given work order, a specific supply of wire can be selected and supplied to the coiling station 20. The feed paths from the wire rolls typically extend through generally parallel wire guide channels 60, 60', 60" which are spaced in the Z direction from the front panel 30 of the machine adjacent the coiling station. The wire selected for a given work order, is then fed from the specific wire guide 60, 60', 60" to the block wire guide 28 for deformation to produce the coil spring. Because the feed locations of the various wire guides and paths have different input positions to the coiling station 20 according to the selected wire, it is necessary to specifically axially align the block wire guide 28 with the wire guide for the given selected wire supply. For example, as illustrated in FIG. 2, the block wire guide 28 can be repositioned in the Z direction to align the block wire guide 28 with guide channel 60' or 60". The cutter 50, pitch tool 36, and coiling point 34 must also be adjustable.

An important component of the total cost of manufacture for an order of a particular type of spring, is the combination of machine down time and operator labor, associated with making such adjustments in setting up the machine to perform the particular operations by which the desired spring is fabricated, and maintaining the effectiveness of these operations, e.g., by the periodic sharpening or replacement of worn tools.

The spacing of the coils in a spring is controlled by the pitch mechanism, which is actuated from behind the front panel 30. The pitch mechanism in one type of conventional machine, is shown in FIG. 3. As the pitch cams 62 on the cam shaft 64 rotate, motion is transmitted to the compound lever 66 through the cam roll lever 68 and compound lever block 70. One end of the cam roll lever 68 is attached to tie rod 86, and one end of the compound lever is attached to the compound lever shaft 72. The pull rod 74 (which is attached to the compound lever) moves up and down with the rocking action of the lever. When the pull rod moves downward, the pitch bell crank 76 pivots causing the pitch tool 36 to move outward from the chuck 40, thus increasing the pitch or distance between coils in the spring being coiled. The pitch tool 36 is attached to drive block 84 via screw 90. The return springs 78 pull the bell crank 76 back when the low portion of the pitch cams 62 roll over the cam roll 80. The pitch stop screw 82 limits the travel of the bell crank 76. While the bell crank is against the stop screw, movement of the pitch tool is stopped and the coils formed in the spring are of a fixed pitch. By turning the pull rod adjusting knob 88 counterclockwise, the cams become inoperative and the spacing of the spring coils become dependent upon the position of the stop screw 82.

Other types of spring coiling machines have different pitch mechanisms, but in all instances, a pre-established control program specifies the movement of the pitch tool 36 toward and away from the face of chuck 40, in relation to the extent of wire that has been fed to the coiling point, such that a non-uniform pitch can be provided between the coils of the completed spring. Such non-uniform pitch can be provided on the one hand, in a spring having coils of uniform diameter, or on the other hand, in a spring where the coil diameters are also non-uniform. Pitch control can be accomplished not only with cam mechanisms of the type shown in FIG. 3, but also with computer controlled mechanisms for achieving the desired program of positioning the tool 36 relative to the front face of the chuck 40.

Regardless of the type of pitch mechanism employed on a particular machine, considerable time is required for initial set up and adjustment, and for the periodic replacement of a worn tool. With reference to FIG. 3, replacement of a pitch tool 36 in the drive block 84 can be simply accomplished by loosening screw 90, removing the old tool, replacing it with a new tool, and tightening the screw 90. This replacement procedure does not necessarily mean that the neutral position and motion of the new pitch tool will duplicate that of the replaced pitch tool.

SUMMARY OF THE INVENTION

It is, therefore, an object of the present invention to provide a pitch tool assembly which simplifies the accurate installation of a new or replacement pitch tool, in a spring coiling machine.

It is another object to provide an improved and simplified technique for driving a pitch tool in a spring coiling machine.

The invention can be summarized as a spring coiling machine wherein the pitch tool holder has two active plates which act as a clamp on the stem of the pitch tool.

Preferably, the active, or clamping plates are carried on a support base plate that is movable linearly in a direction parallel to the pitch stem axis.

Thus, the pitch tool holder according to the invention, represents a new way to clamp a round or shaped pitch tool stem, preferably in an arrangement whereby the pitch tool holder is driven in a programmed motion along a direction perpendicular to the face of the machine. The holder according to the invention, has no pivot points or hinges, as in the conventional coiling machine. On a conventional machine, the operator must position the pitch tool stem into the hole in the pitch clamp mechanism, while holding the mechanism and the pitch tool. With the holder according to the invention, the stem of the pitch tool is merely slid between the active plates, whereupon the plates are easily tightened to clamp the stem. The plates are, in essence, self aligning, and can accommodate a wide variety of chuck style and pitch stem size.

When driven linearly according to the preferred embodiment, the pitch tool holder can optionally be used as a rear motion slide for other applications. In this situation, a pitch wedge can be incorporated into one of the other drive pick off points on the machine.

BRIEF DESCRIPTION OF THE DRAWINGS

The present specification is accompanied by drawings, wherein like numerals refer to like structure, in which.

DESCRIPTION OF THE PREFERRED EMBODIMENT

Figure 4:
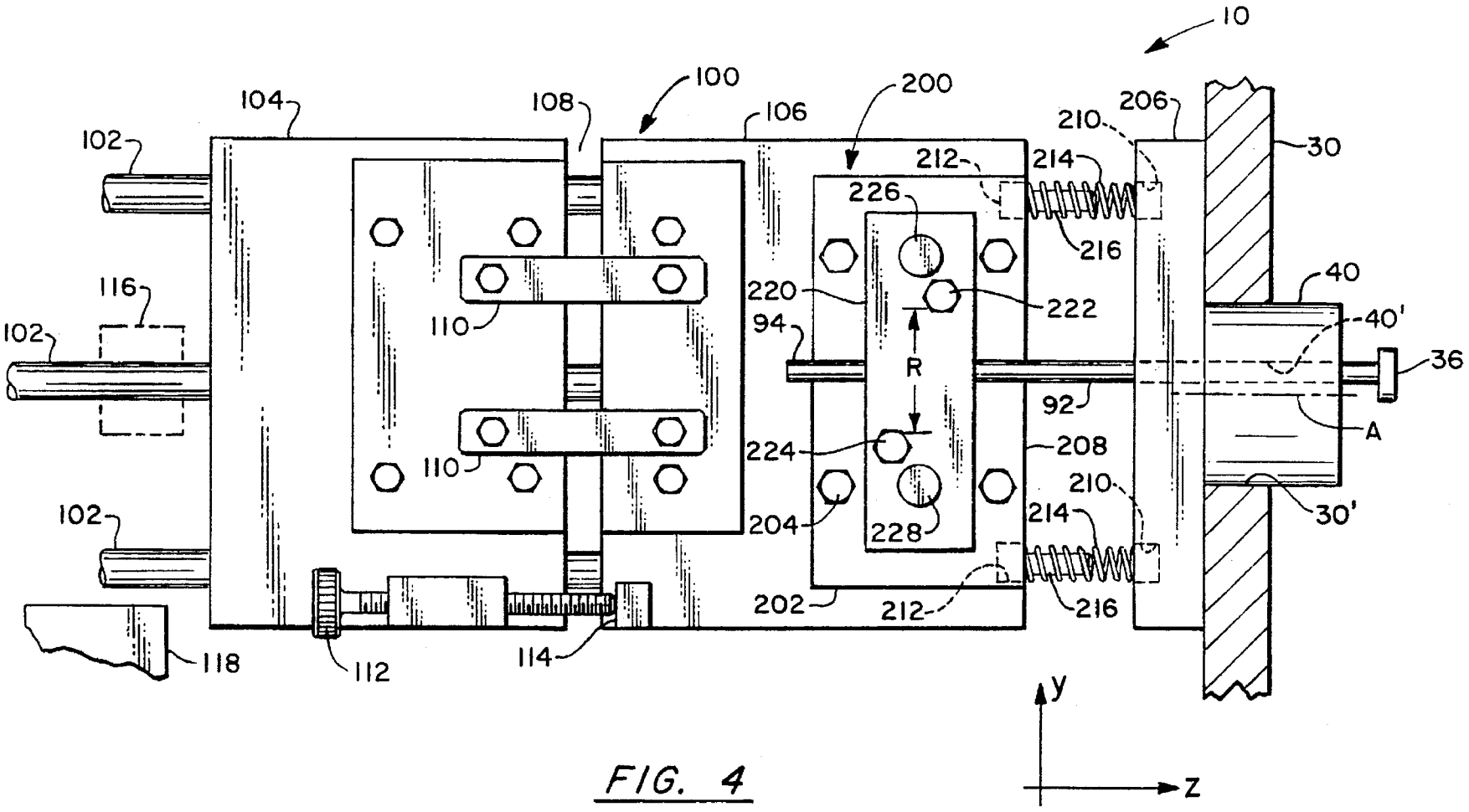
FIG. 4 is a side view of the present invention implemented in an embodiment wherein the pitch tool is driven by a bearing slide.
Figure 5:
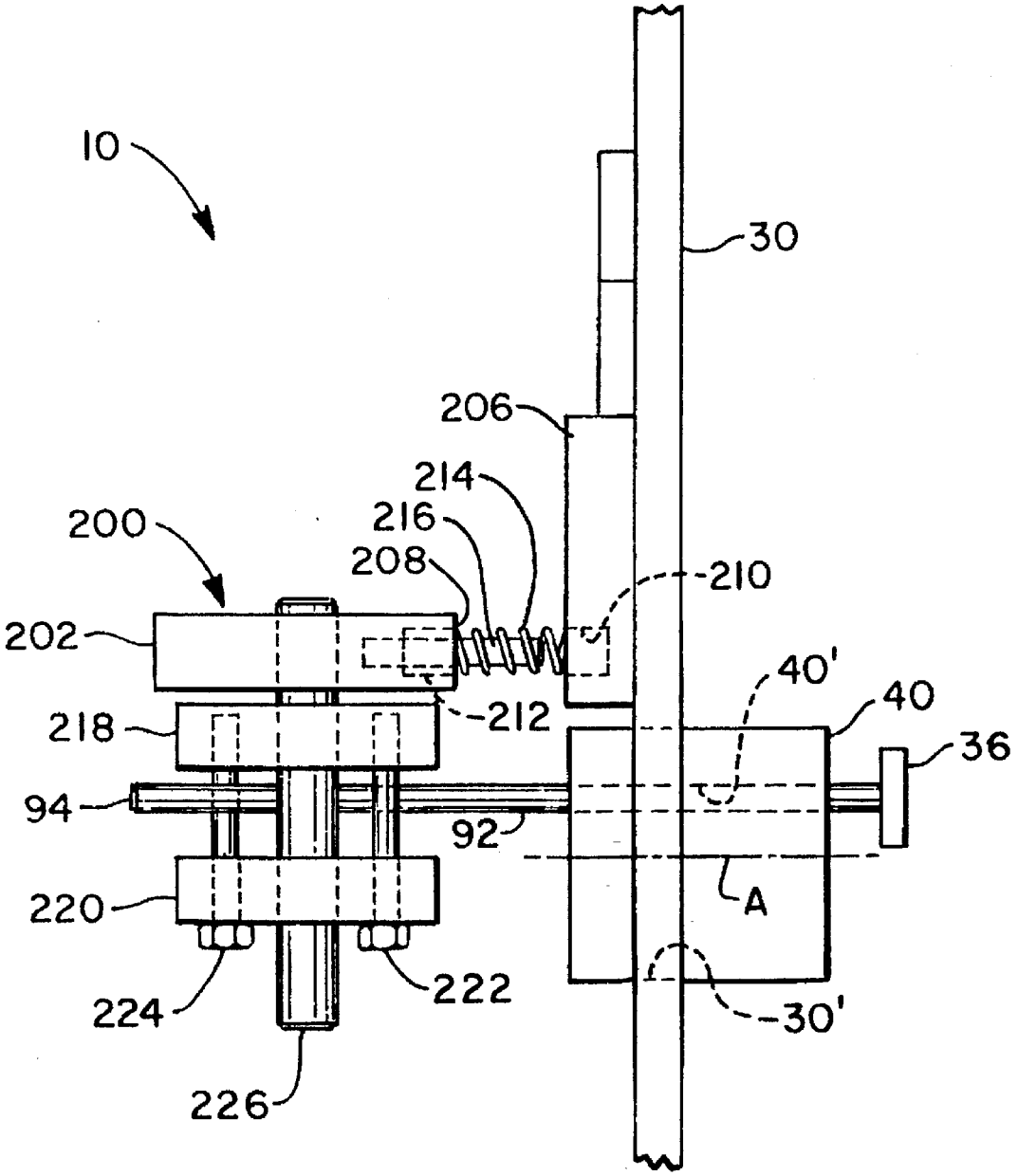
FIG. 5 is a schematic plan view of the pitch tool assembly shown in FIG. 4.

FIGS. 4 and 5 illustrate an embodiment of the invention 100 as implemented in a spring coiling machine having a linear slide mechanism 100 programmed to control the movement of the pitch tool 36 during the forming of the coils for each spring. The details of the slide mechanism 100 need not be explained, because those familiar with this field understand that such slides can appear in a variety of forms with a variety of options and adjustments for achieving the desired motion toward and away from the front panel 30, i.e., in the Z direction, parallel to the bore 40' for the pitch tool to pass through the chuck. In general, however, the compound slide mechanism shown in FIG. 4 includes three parallel slide bars 102 and two slide blocks 104,106 having bearings (not shown) permitting relative movement between the bars and the blocks. The spacing 108 between the blocks along the bars is adjustable, via bridging members 110 and an adjustment screw 112 carried by the first block 104 and bearing upon a shoulder 114 carried by the second block 106. For present purposes, one need only appreciate that the second block 106 is movable linearly toward and away from the front panel 30.

A pitch tool holder base plate 202 is fixed to the second block 106 via bolts 204, and is therefore linearly moveable toward and away from the front panel with the second block. Other arrangements are also readily derivable, for achieving the desired linear movement of the base plate 202 commensurate with the pitch tool control program defined by cams or digital processors. For example, the base plate 202 could be integral with the driven block such as 106.

Figure 1:
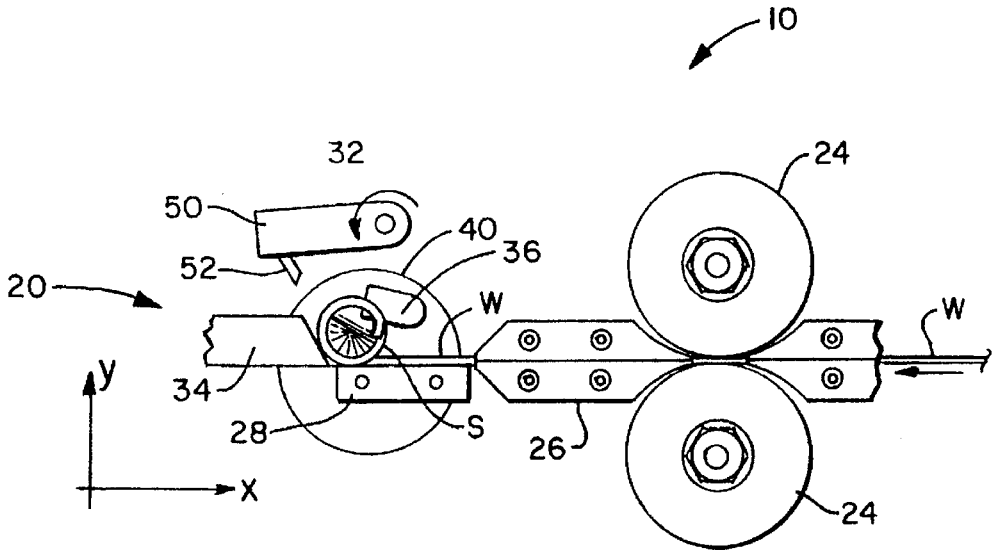
FIG. 1 PRIOR ART
FIG. 1 shows the main operational components on the front face of a typical spring coiling machine.
Figure 2:
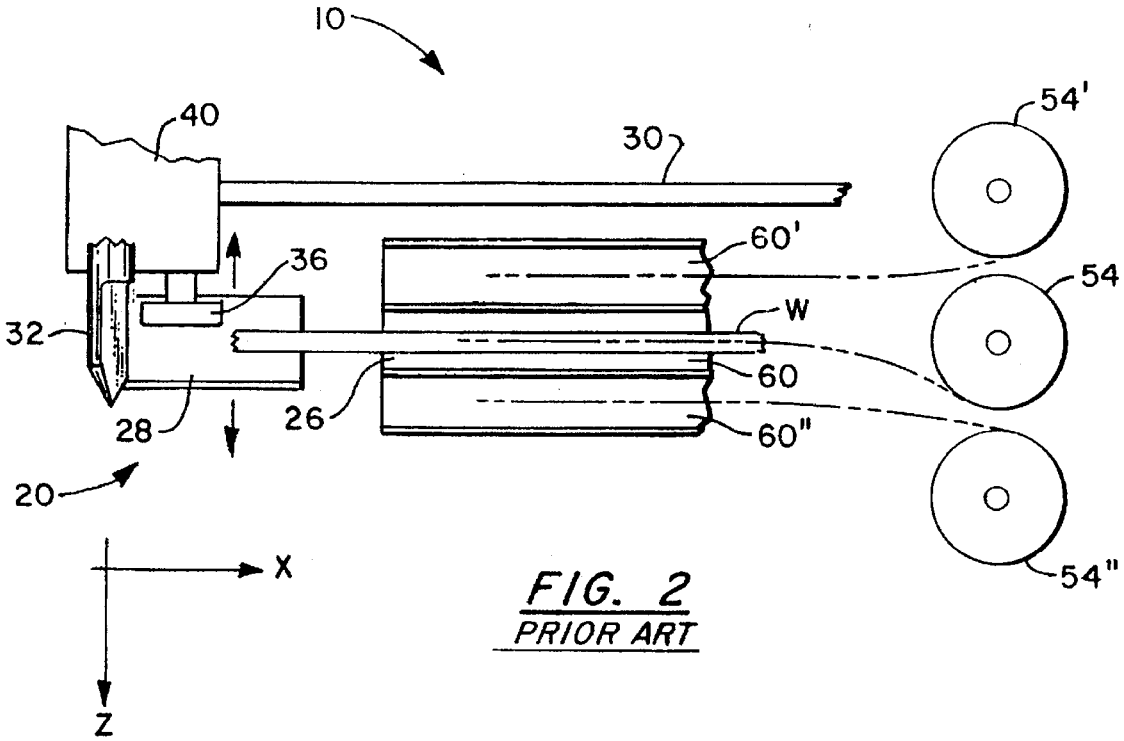
FIG. 2 PRIOR ART
FIG. 2 shows a plan view of the components at the front face of the machine, corresponding to FIG. 1.
Figure 3:
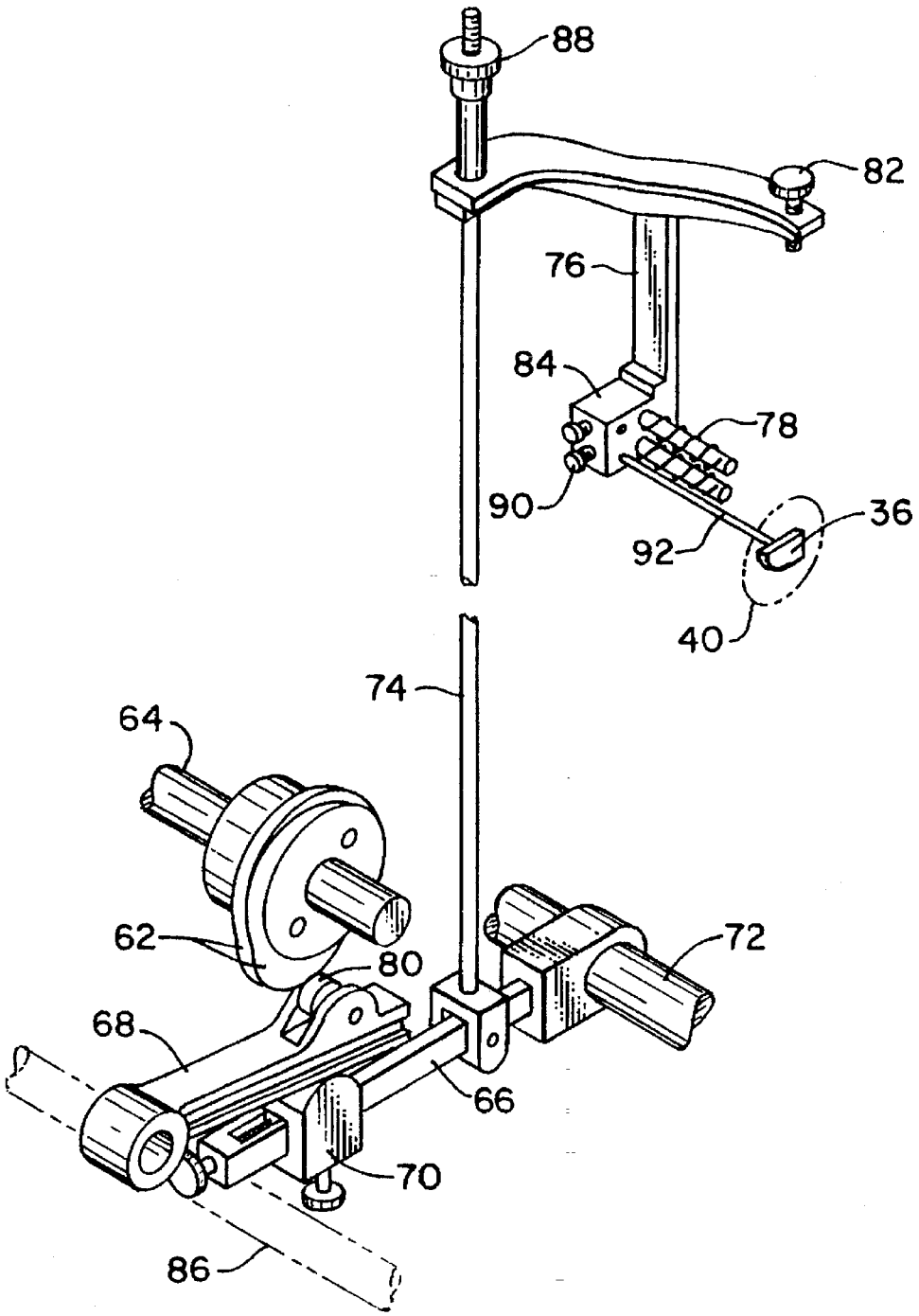
FIG. 3 PRIOR ART
FIG. 3 is a schematic representation of a prior art pitch mechanism, which illustrates the operation and alignment difficulties.

A panel plate 206 is fixed to the inside of the front panel 30, adjacent to the opening 30' in the panel, in which the chuck 40 is situated. The forward side 208 of the base plate 202 confronts the panel plate 206, such that blind bores 210,212 in the panel plate and base plate register coaxially. Tension springs 214 along pilot rods 218 supported in the bores, bias the base plate 202 away from the panel plate 206. This bias is analogous to the function of spring 78 in FIG. 3, and can be implemented in ways other than shown in FIGS. 4 and 5.

The pitch tool has an active end 36 which projects from the chuck 40 outside the front panel 30, with the stem 92 passing coaxially through the bore 40' in the chuck. The other, held end 94 of the stem 92 is well inside the machine, near the base plate 202. Two active plates 218,220 are spaced apart transversely to the axis of stem 92, each active plate bearing against the held end 94 of the stem. Screws 222,224 above and below the stem 92, span the space between and engage the active plates 218,220, for drawing these plates together tightly against the stem.

The active plates 218,220 are supported by the base plate 202, on a pair of dowels 226,228 or the like which are fixed to the base plate and project therefrom transversely to the axis of the stem, i.e., in the X direction. The first active plate 218 is adjacent to but spaced from the base plate 202. The dowels 226,228 and screws 222,224 are situated above and below the radius R from the chuck central axis A, within which one would expect to find the bore 40' for the pitch tool stem 92. Thus a range of possible positions can be accommodated for the stem, along the Y direction.

Because the active plates 218,220 are slidable along the dowels, 226,228 the attachment of the stem to the active plates can occur over a range along the X direction. Similarly, the stem can be adjustably positioned along the bore axis (i.e., in the Z direction) before clamping between the active plates.

It should thus be appreciated that whether the operator installs a new chuck 40 when setting up a machine initially to fabricate a particular type of spring, or merely wishes to replace a pitch tool 36 after excessive wear, the stem 92 of the pitch tool can easily be clamped on any axis parallel to the Z direction, which passes through a generous cross sectional area in the X-Y plane immediately behind the chuck. In particular, the active plates 218,220 can be adjusted to provide sufficient space for the unobstructed insertion of the stem between them. A new stem is passed through the chuck bore 40' from the outside until the end 94 is immediately in front of the active plates. The operator slides the plates as a pair along the dowels until the end of the stem is aligned with the space. The stem is then pushed through the space until, e.g., the active end 36 abuts the front face of the chuck. The active plates 218,220 are then tightened.

Preferably, the drive assembly such as the linear slide mechanism 100 can be driven to a stop surface such as 118, thereby defining a fully retracted position relative to the front panel 30. A degree wheel 116 or the like associated with the movement of the slide mechanism 100, is set to read "0" when the slide mechanism 100 is in its fully retracted position, against the stop 118. By then inserting a new pitch tool into the chuck 40 until the active end 36 abuts the front face of the chuck, then clamping the stem 92 between the active plates to 218,220, the entire pitch tool assembly initial or reference condition, can be reproduced time after time. By then moving the slide mechanism 100 to a preestablished position according to the degree wheel 116, the pitch tool 36 can be adjusted to a known and reproducible starting position in front of the chuck face, whereby machine setups can be readily duplicated. Other references can be used to determine the Z position at which the stem should be clamped, based on for example, a stop position of the base plate or slide block, resulting from the bias of the tension springs.

Although the term "plate" has been used to refer to various components, this should not be understood as a limitation which excludes structures having a different shape and which can perform the same or equivalent functions as the plates described in the present context.

I claim:

1. In a spring coiling machine having a front panel defining an outside and an inside of the machine, a chuck supported perpendicularly through the panel, a pitch tool having a tool axis passing substantially coaxially through a bore in the chuck and including an active end situated outside the machine and a held end situated inside the machine, and a pitch tool holder situated inside the machine for holding said held end of the pitch tool, wherein the improvement comprises said pitch tool holder having two active plates spaced apart transversely to said tool axis, each plate bearing against the held end of the pitch tool, and means for selectively moving the active plates toward and away from each other.

2. The improvement of claim 1, wherein the pitch tool holder includes a base plate adjacent one of the active plates, and dowel means supported by the base plate and passing through the active plates such that, in the absence of the pitch tool therebetween, the active plates can slide toward and away from the base plate.

3. The improvement of claim 1, wherein the means for selectively moving the active plates includes at least one screw spanning said space and engaging said active plates.

4. The improvement of claim 1, wherein the pitch tool holder is rigidly connected to a drive mechanism which moves parallel to the axis of the bore in said chuck while the machine is forming coils on a spring.

5. The improvement of claim 2, wherein said base plate is rigidly connected to a slide mechanism which is programmed to move parallel to the axis of the bore in said chuck while the machine is forming coils on a spring.

6. The improvement of claim 4, including stop means for defining a limit of movement of the drive mechanism away from said chuck, and indicator means, for displaying to the operator, a measure of the displacement of said drive mechanism from said stop means, toward said chuck.

7. A pitch tool assembly for a spring coiling machine, comprising:

a chuck having a throughbore along a bore axis, for receiving a stem portion of the pitch tool coaxially along the bore axis;

a linear slide mechanism programmable for controlled movement toward and away from said chuck, in a direction parallel to said bore axis;

a pitch tool holder attached to said slide mechanism for movement therewith, said holder including a pair of clamping plates situated on either side of said bore axis and means for selectively moving the clamping plates toward and away from each other to clamp said stem.

8. The pitch tool assembly of claim 7, wherein the pair of clamping plates is slidable as a unit, in a direction transverse to said bore axis.

9. The pitch tool assembly of claim 8, further including stop means for limiting the movement of said slide mechanism, away from said chuck.

10. The pitch tool assembly of claim 9, further including means for indicating a measure of the displacement of said slide mechanism, from said stop means toward said chuck.

* * * * *